US005291258A

United States Patent [19]

Cain et al.

[11] Patent Number: 5,291,258

[45] Date of Patent: Mar. 1, 1994

[54] SUPPORT SKI FOR FILM CLEANING DEVICE

[75] Inventors: James H. Cain, Brockport; Michael W. Mosehauer, Rochester; Andrew J. Mauer, Warsaw; Richard C. Hutchings, Rochester, all of N.Y.

[73] Assignee: Eastman Kodak Company, Rochester, N.Y.

[21] Appl. No.: 971,106

[22] Filed: Nov. 4, 1992

[51] Int. Cl.[5] ..... G03G 21/00

[52] U.S. Cl. ..... 355/296; 15/256.5; 15/256.51; 355/301

[58] Field of Search ..... 355/296, 305, 301, 299, 355/300, 298, 297; 15/256.5, 256.51, 256.52; 118/652

[56] References Cited

U.S. PATENT DOCUMENTS

| | | | |
|---|---|---|---|
| 4,230,406 | 10/1980 | Klett | 355/298 |
| 4,499,849 | 2/1986 | Tomita et al. | 118/652 |
| 4,501,484 | 2/1985 | Shimura | 355/298 X |
| 4,571,070 | 2/1986 | Tomita | 118/652 X |
| 4,797,708 | 1/1989 | Kasiske, Jr. et al. | 355/296 |
| 4,949,133 | 8/1990 | Landa | 355/296 |
| 4,959,691 | 9/1990 | Satoh | 15/256.51 X |

FOREIGN PATENT DOCUMENTS

| | | | |
|---|---|---|---|
| 0016277 | 1/1983 | Japan | 355/305 |
| 0228279 | 12/1984 | Japan | 355/297 |
| 0147779 | 8/1985 | Japan | 355/297 |
| 0164784 | 8/1985 | Japan | 355/296 |

*Primary Examiner*—A. T. Grimley
*Assistant Examiner*—William J. Royer
*Attorney, Agent, or Firm*—Leonard W. Treash, Jr.

[57] ABSTRACT

In electrographic apparatus a latent image on a flexible photoconductor is developed with toner particles at a development station and subsequently transferred to a receiver sheet, such as a copy sheet, and then fused to the sheet. Sometimes unwanted particles are on the photoconductor, including the area where an image is to be developed on the photoconductor. These particles are removed by a magnetic brush system located closely adjacent the surface of the photoconductor prior to the charging station. A biased ski located under the photoconductor presents the photoconductor to the cleaning nap at a predetermined uniform pressure and a desired distance, so that the photoconductor is uniformly cleaned and buffed.

6 Claims, 3 Drawing Sheets

SUPPORT SKI FOR FILM CLEANING DEVICE

BACKGROUND OF THE INVENTION

1. Field of the Invention

The present invention relates to apparatus for uniformly buffing and removing unwanted particles from the surface of a photoconductor, so that the photoconductor may be restored to a condition suitable for immediate re-use in an electrographic apparatus.

2. Description of the Prior Art

Images are formed in an electrographic apparatus by moving a photoconductor, in the form of a drum or flexible web, past a series of stations in the apparatus. As this occurs, the photoconductor is charged, exposed to form a latent charged image on the photoconductor, and the image is then developed by moving it past a development station where charged toner particles of developer material are attracted to the charged latent image to develop the image. The developed image is then transferred to a receiver sheet, such as a sheet of paper, at a transfer station. The receiver sheet, carrying the developed image, is advanced through a fusing station where the toner particles are heated and fused to the sheet. Particles remaining on the photoconductor, after transfer to the copy sheet has occurred, are removed at a cleaning station prior to recharging the photoconductor and repeating the copy process.

During the above processes of charging, developing, transfer and cleaning, each subsystem of the process interacts with the others. However, most interaction takes place between immediate neighboring systems. In the case of the cleaning subsystem, the effects of transfer and charging have the most effect on cleaning. The toner that remains behind on the photoconductor, after transfer, has to be cleaned off the photoconductor before the charger can uniformly charge the film web, since the charging system is designed to charge a cleaned photoconductive surface. If the surface is not uniformly cleaned, the desired levels of charge needed on the photoconductor will not be achieved.

Since the photoconductor is used over and over again for thousands or perhaps hundreds of thousands of images, its surface must be continuously restored. Therefore, the photoconductor must be buffed, as well as cleaned, at a controlled and uniform rate. The required buffing rate is dependent upon the application. Sometimes it is necessary to buff the photoconductor very aggressively. A magnetic brush cleaner system, is one of the typical systems used with electrophotographic copiers, printers and the like, to remove residual toner and buff the surface of the photoconductor after transfer. One type of magnetic brush cleaning system that is used has a very dense nap of coarse magnetic particles, but unfortunately, this type of nap has little compliancy. To overcome this compliancy problem when using a photoconductor belt in the form of a loop, one usually attempts to obtain the necessary compliancy by optimizing the loop support system in the vicinity of the cleaning apparatus in hopes of maintaining buffing uniformity over the width of the photoconductive web.

At the present time, one loop system that accomplishes the above consists of two stationary skis that straddle the cleaning brush where the deflection of the photoconductive belt occurs, between the two skis, to provide sufficient compliancy for cleaning. A problem with this technique is the tedious procedures required to position the skis in the correct position. The total tolerance window, in fact, being a mere 0.005 inches or less. This results in a need to match the cleaning apparatus to the film core in the electrophotographic apparatus at the factory level. Exchange of parts or repairs in the field become more difficult because of this condition.

SUMMARY OF THE INVENTION

Accordingly, it is an object of the invention to provide a cleaning system for removal of unwanted particles from a flexible photoconductor that is not subject to precise installation tolerances.

The invention relates to an apparatus for cleaning a recording medium in the form of an endless belt extended between at least a pair of rollers, having a recording surface on which a developed image comprised of particles is formed and a back surface opposite said recording surface, the cleaning apparatus comprising:

means for removing residual particles on the recording surface, said means for removing being disposed on the recording surface side of said recording medium;

supporting means for supporting the back surface of the recording medium and for biasing the recording surface toward said means for removing residual particles, said supporting means including:

a support member having a supporting surface which faces the back side of said recording medium, a flexible member on which the supporting member is mounted, and a biasing means for urging the support member, by itself and with the flexible member, toward the means for removing to urge the supporting surface against the back side of the recording medium.

The main advantage of the present invention is that set-up time is reduced, since tight cleaning apparatus to web tolerances are no longer required, due to a spring mechanism that automatically maintains the relationship between the web and cleaning system. No set-up tools or fixtures are required at the time of assembly, since the parts are located by integral features alone with the spring mechanism providing the installation tolerances.

Another advantage of the invention is its ability to maintain a predetermined pressure contact between a cleaning brush and a flexible web photoconductor entrained about a plurality of rollers.

Still another advantage of the invention is its ability to adapt to spacing and skew variations between the magnetic brush cleaning nap and the flexible web, even if said nap is not uniform.

BRIEF DESCRIPTION OF THE DRAWINGS

In the detailed description of the preferred embodiment of the invention presented below, reference is made to the accompanying drawings, in which.

DESCRIPTION OF A PREFERRED EMBODIMENT

Figure 1:
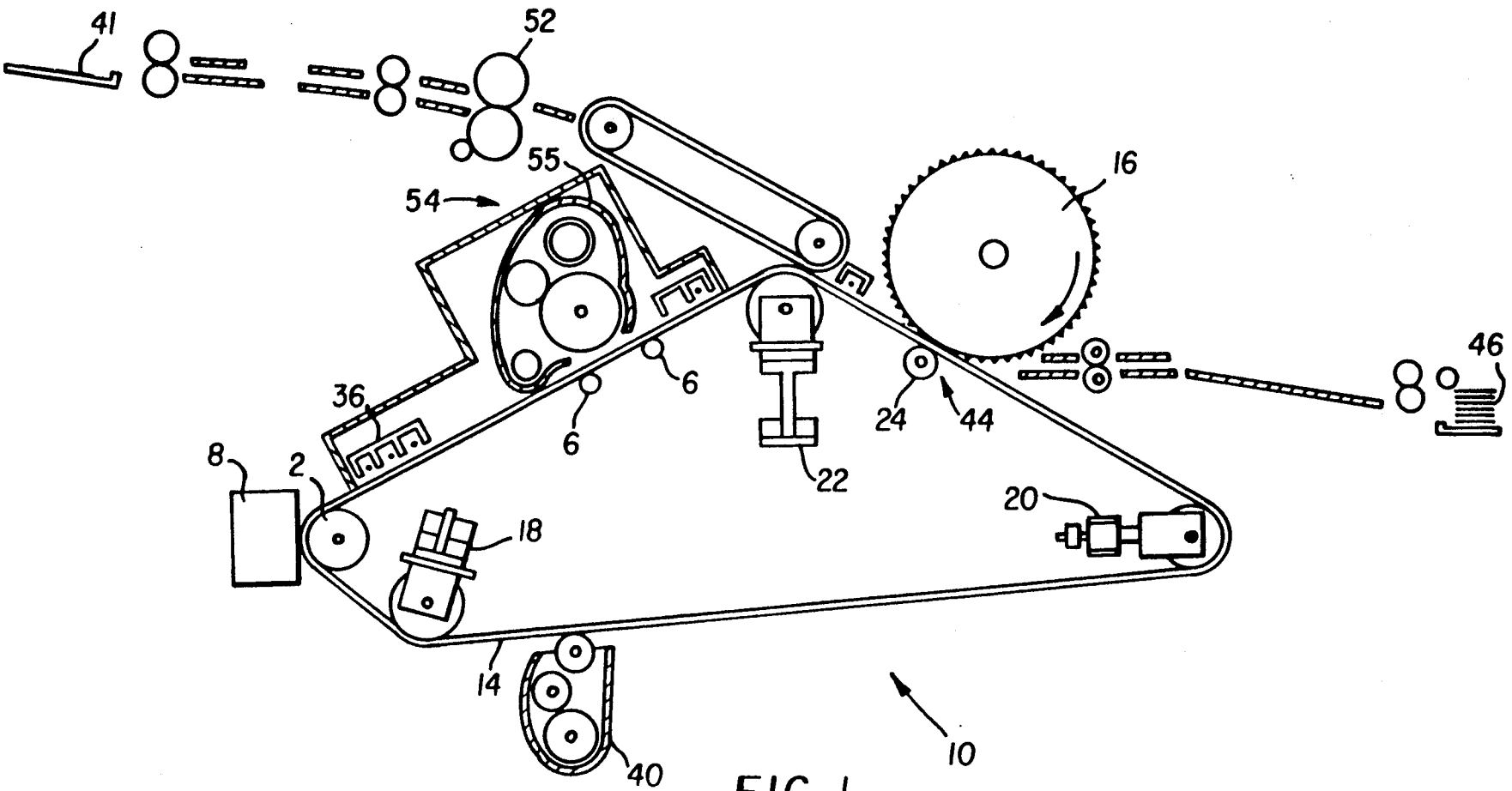
FIG. 1 (prior art)
FIG. 1 is a side schematic view of a portion of a prior art electrographic apparatus.

The apparatus of the preferred embodiment will be described in accordance with an electrostatographic recording medium. The invention, however, is not limited to methods and apparatus for creating images on such a medium, as other media such as photographic film, etc. may also be used to advantage within the spirit of the invention.

Because electrostatographic reproduction apparatus are well known, the present description will be directed in particular to elements forming part of, or cooperating more directly with, the present invention. Apparatus not specifically shown or described herein are selectable from those known in the art.

While the present invention is susceptible to embodiments of many different forms, there is shown in the drawings and hereinafter described, in detail, a preferred embodiment of the invention. It should be understood, however, that the present disclosure is to be considered an exemplification of the principles of the invention and is not intended to limit the invention to the embodiments illustrated and/or described.

For ease of description, all apparatus will be described in their normal operational position, and terms such as upper, lower, horizontal, etc., will be used with reference to normal operating positions. All apparatus, however, may be manufactured, stored, transported and sold in an orientation other than the normal operational positions described.

All references cited in this specification, and their references, are incorporated by reference herein where appropriate for appropriate teaching of additional or alternative details, features and/or technical background.

Throughout the following description, similar reference characters refer to similar elements or members in all of the drawing figures.

Referring initially to FIG. 1, a prior art film core portion of a copier or printer, generally designated 10, includes a recording medium, for example, an endless electrophotoconductive web 14 entrained about a series of rollers 18, 20 and 22 as well as other supporting structure. Web 14 is driven about rollers 18, 20 and 22 though a series of electrophotographic stations generally well-known in the art. More specifically, a uniform charge is laid down on web 14 by a charging station 36. Uniformly charged web 14 moves around printhead roller 2 which is directly opposite an LED printhead 8. LED printhead 8 exposes web 14 in a manner well-known in the art to form a latent image on web 14. Exposed web 14 then moves into operative relation with a toning or developing station 40. Each image, on web 14, created by printhead 8 is toned at toning station 40. The toned image, carried on web 14, then passes adjacent a transfer station 44 where the image is transferred to a transfer medium 46, such as a sheet of paper, carried by transfer drum 16 backed by backing roller 24.

Transfer drum 16, as is well known in the art, cooperates with web 14 to incrementally bring sheet 46 and the toned image into transfer relation so that the toned image is transferred to receiving sheet 46. After transfer is complete, sheet 46 is allowed to follow web 14 until it is separated from web 14 and transported to a fuser 52. After sheet 46 leaves fuser 52, it is directed to an output tray 41 for delivery to the apparatus operator.

Figure 3:
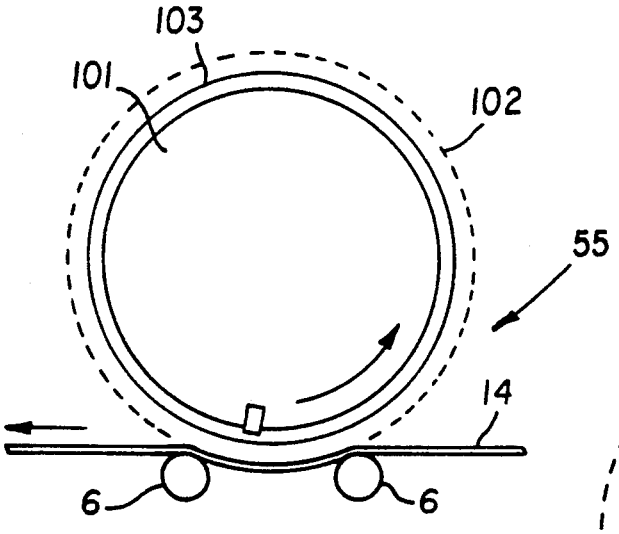
FIG. 3 (prior art)
FIG. 3 is an exploded side view of the prior art cleaning apparatus illustrated in FIG. 1.

That portion of web 14, from which separation of sheet 46 occurred, is then cleaned, by the application of a neutralizing corona, a neutralizing erase lamp and a magnetic brush cleaning mechanism all located at a cleaning carriage 54. Cleaning station 55, located in carriage 54, of the prior art (see FIGS. 1 and 3) includes a fixed magnetic core 101, having an outer shell 103 which is rotated in a counter-clockwise direction and a brush or fiber nap 102 consisting of magnetic particles, such as stainless steel, adhered to outer shell 103 as a result of the magnetic force of magnetic core 101. Skis 6 straddle cleaning station 55 and act as support members on that side of web 14 opposite from the recording surface side where the toned image is formed and magnetic brush 105 is brought into contact with web 14.

After leaving cleaning station 55, photoconductor belt 14 is subjected to recharging at charging station 36. An electrographic apparatus 10, as generally described hereinbefore, is known in the art and is disclosed, for example, in commonly assigned U.S. Pat. No. 4,821,066 entitled "Non-Impact Printer" which issued on Apr. 11, 1989 in the name of James C. Foote, Jr. et al.

Figures 5, 6, 7, 8:
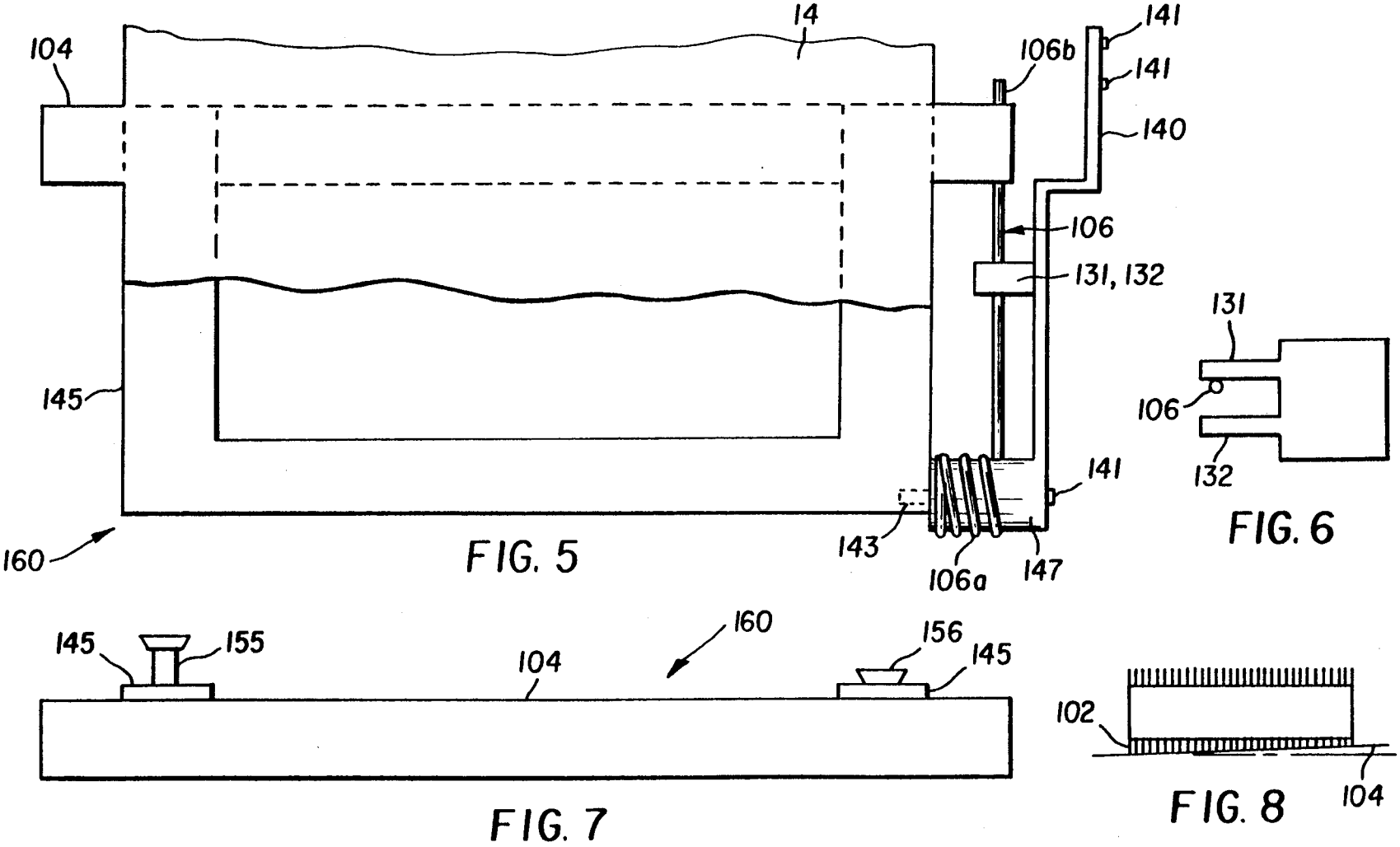
FIG. 5 is a top view of the flexure assembly.
FIG. 6 is a front view of a bracket of the flexure assembly.
FIG. 7 is a front view of the flexure assembly.
FIG. 8 is a front view of the magnetic brush showing a skew in the nap.

In the present invention, skis 6 are replaced by a single ski 104 secured to a sheet metal flexure 145, as shown in FIG. 5. Sheet metal flexure 145 is secured for rotation in a set of brackets 140 that are affixed, by retainer mounts 141, to electrographic apparatus 10. A spring bracket arbor 147, of brackets 140, has a shaft 143 upon which flexure plate 145 mounts, as previously stated for rotation. A coil portion 106*a* of each torsion spring 106 is inserted over arbor 147 with end 106*c*, of coil portion 106*a*, secured to arbor 147 (see FIG. 2). End 106*b* of torsion spring 106 is positioned such that it makes contact with the underside of ski 104 thereby allowing torsion springs 106 to maintain ski 104 in a predetermined pressure contact with the underside of web 14. This predetermined pressure contact of ski 104 with web 14 ultimately positions, as later explained, web 14 in the predetermined pressure contact with cleaning nap 102 of magnetic brush 105.

As shown in FIG. 7, one end of ski 104 is firmly secured to sheet metal flexure plate 145 by a securing device 156, such as a screw, and the other end is secured by a standoff 155. Standoff 155 allows one end of ski 104 to freely move in a direction generally perpendicular to flexure plate 145 and, when ski and flexure assembly 160 are installed in apparatus 10, standoff 155 allows ski 104 to move generally perpendicular to web 14. Standoff 155 and screw 156 restrain ski 104 from any other movement in relation to flexure plate 145. With this type of restraint, torsion springs 106, located at each end of ski 104, are able to operate in combination with each other, to move each end of ski 104, by exerting a force to the underside of each end of ski 104 thereby causing a flexing of flexure plate 145. This causes ski 104 to move, in relation to web 14, and thereby bring web 14 into an optimum predetermined pressure contact with nap 102 of magnetic brush 105. Torsion springs 106 may also work somewhat independent of each other, such that the end of ski 104, retained by standoff 155 may move both as to standoff 155 and with flexure plate 145 to compensate for any non-parallelism or skew (see FIG. 8) of nap 102 in relation to web 14. The end result, of either the cooperative or the independent working of torsion springs 106, is the positioning of nap 102, web 14 and ski 104 parallel to each other. To prevent static charge build-up on the backside of web 14, ski 104 is grounded via a wire, not shown, but known in the art, connected to flexure 145.

Figure 2:
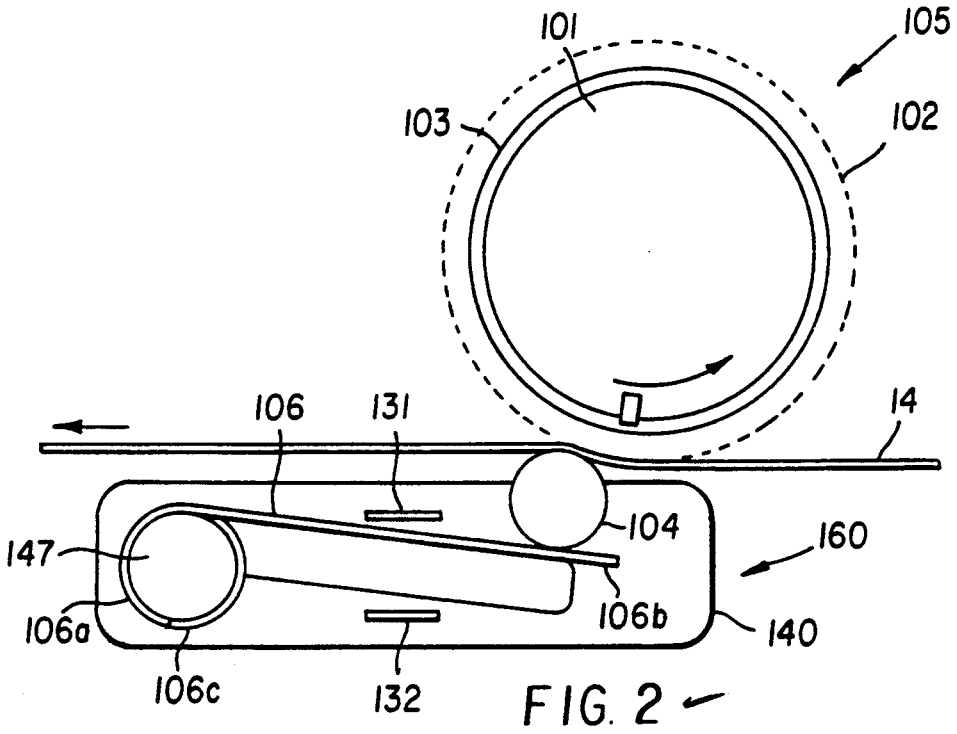
FIG. 2 is a side view of the cleaning apparatus of the present invention which replaces the cleaning apparatus shown in FIG. 1.

As shown in FIGS. 2 and 6, ends 106*b* of torsion springs 106 are restricted in their movement by stops 131 and 132 on brackets 140. Stops 131 and 132 prevent torsion springs 106 from moving ski 104 too far and thereby pinching web 14 too tightly between ski 104 and magnetic roller 105. In addition, stops 131 and 132, are positioned sufficiently apart so that ends 106*b*, of torsion springs 106, may move ski 104 to compensate for any stretching of web 14, yet restrict the movement of torsion springs 106 to prevent web 14 from becoming too taunt about rollers 18, 20 and 22 or its support system. There is, however, sufficient spacing, between stops 131 and 132, so that torsion springs 106 are able to move a sufficient distance to maintain ski 104, nap 102 and web 14 in parallel relationship to each. This is accomplished by torsion springs 106 moving ski 104 such that it causes web 14 to make parallel contact with nap 102, either through the cooperative movement of ski 104 with flexure plate 145 and over standoff 155, movement of ski 104 only with flexure plate 145 or movement of ski 104 only over standoff 155. Stops 131 and 132 also assist in removal or replacement of web 14, since ski 104, due to the restriction of its movement by stops 131 and 132, (see FIGS. 2 and 6) is prevented from positioning web 14 such that web 14 would be so tight as to hinder its removal.

Because ski 104 as above described maintains the recording surface of web 14 in constant uniform contact with nap 102 of magnetic brush 105, the removal of the residual toner particles, remaining on the surface of web 14, can be carried out efficiently as well as uniformly at all times. The toner particles thus removed from web 14 are collected in nap portion 102 of magnet brush 105 while it rotates, by means known in the art, but not shown.

While in the above preferred embodiment, ski 104 is depicted as movable with flexure plate 145, magnet brush 105 may, instead, be the movable member. This is accomplished by attaching the shaft, about which shell 103 rotates to flexure plate 145, while securing ski 104 in a stationary position within apparatus 10. In this manner there is still a biased relationship between nap 102, of brush 105, and ski 104, with a part of web 14 sandwiched therebetween.

Figure 4:
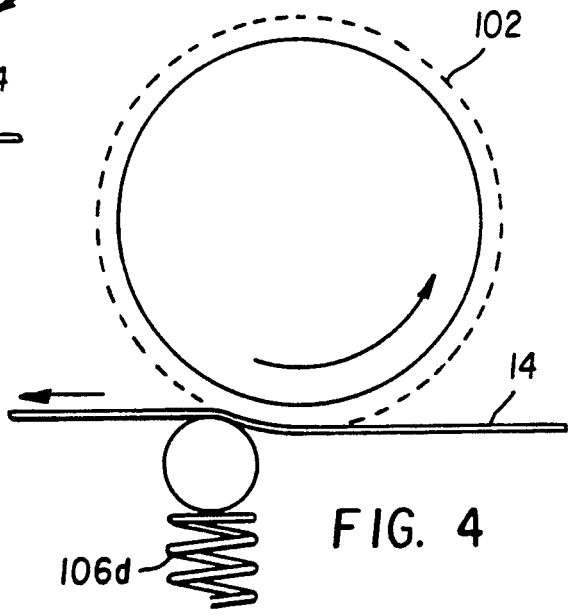
FIG. 4 is another embodiment of the cleaning apparatus in accordance with the present invention.

The preferred means for urging ski 104 into contact with web 14, in the present invention, are the heretofore mentioned constant force torsion springs 106, shown in FIG. 2. Torsion springs 106 are preferred, since such springs are space efficient and can be designed with a low spring constant to provide minimum sensitivity to the exact positioning of ski 104, in apparatus 10, adjacent to both web 14 and cleaning station 55. It should be appreciated, however, that a compression spring 106*d* (see FIG. 4) or a flat leaf spring, not shown, but known in the art, could also be used, but both compression springs and flat leaf springs are more sensitive to manufacturing and positional tolerances than torsion springs. While the urging or biasing means depicted throughout all the drawings are springs, the urging means is not limited to springs and other urging devices may be used that are known in the art.

By using the biased single ski 104, of the present invention, the problems related to fixed dual skis 6, of the prior art, are eliminated. There is no need to perform the tedious task of having to align skis 6 in uniform front to rear relation with shell 103 of magnetic cleaning roller 105. Ski 104 is merely placed slightly downstream of the vertical center line of magnetic cleaning brush 105 to prevent undue pinching of nap 102 between shell 103 and web 14. This positioning allows the force of torsion springs 106 to adjust the position of ski 104 and apply the proper predetermined pressure between web 14 and nap 102. In addition, if cleaning nap 102 is not uniform from front to rear, web 14 will still be uniformly buffed, since the movement of ski 104 with flexure plate 145 and standoff 155 will cause web 14 to conform to or mimic the nonuniformities of cleaning nap 102 to assure uniform cleaning and buffing, see FIGS. 7 and 8.

To install flexure plate assembly 160 in electrographic apparatus 10, one merely lines up pins 141 (see FIG. 5) of bracket 140, which is located on both sides of flexure plate 145, but in FIG. 5 only shown on one side, with mating mounting holes, not shown but known in the art, in electrographic apparatus 10. This automatically positions ski 104 just down stream of cleaning station 55 (see FIG. 2). In this manner, as web 14 travels in the nip formed by nap 102 of magnetic brush 105 and ski 104, springs 106 urge ski 104 into contact with the underside of web 14. This urges the top side of web 14 into contact with nap 102 of magnetic brush 105. If nap 102 is not parallel with web 14 (see FIG. 8), then, due to the capability of ski 104 to either move with flexure plate 145 or standoff 155 or the combination of the two, ski 104 will position itself to maintain web 14 conformed to nap 102, so that nap 102 uniformly buffs and cleans web 14 as it passes through the nip formed by ski 104 and nap 102. In this manner, uniform pressure may be maintained in the full nip between ski 104 and nap 102 of magnetic brush 105. Because of this uniform pressure, magnetic brush 105 is able to uniformly clean web 14 and eliminate any image disturbing particles on web 14.

The invention has been described in detail with particular reference to a preferred embodiment thereof, but it will be understood that variations and modifications can be effected within the spirit and scope of the invention.

We claim:

1. Apparatus for cleaning a recording medium in the form of an endless belt movable in an in-track direction and extending between at least a pair of rollers, said recording medium having a recording surface on which a developed image comprised of particles is formed and a back surface opposite said recording surface, the cleaning apparatus comprising:

means for removing residual particles from the recording surface, said means for removing being disposed on the recording surface side of said recording medium;

supporting means for supporting the back surface of the recording medium and for biasing the recording surface toward said means for removing residual particles, said supporting means including:

a support ski having a supporting surface which faces the back surface of said recording medium and is curved in the in-track direction, a flexible member on which a first end of the support ski is securely mounted, and a biasing means for urging the support ski, by itself and with the flexible member, toward the means for removing to urge the supporting surface against the back surface of the recording medium.

2. The cleaning apparatus of claim 1 wherein said ski has a second end opposite the first end, which second end is slidably mounted to said flexible member for movement toward and away from the means for removing residual particles and the flexible member.

3. The cleaning apparatus of claim 1 wherein the biasing means is a pair of torsion springs in contact with the support ski.

4. A support apparatus for a recording medium in the form of an endless belt extended between at least a pair of rollers, said medium having a recording surface on which a developed image is formed and a back surface opposite said recording surface, said support apparatus comprising:

a non-rotating ski defining a supporting surface which faces and slidingly engages the back surface of said recording medium, a flexible member on which the ski is mounted, a biasing means for urging the ski toward the recording medium, to urge the supporting surface by itself and with the flexible member against the back surface of the recording medium, and means associated with said ski for adjusting the position of the ski with respect to the back surface of the recording medium, such adjusting means including means for fixing the flexible member to a first end of the ski and means for coupling a second end of the ski to the flexible member which means for coupling permits relative movement between the ski and the flexible member toward and away from the recording medium.

5. The support apparatus of claim 4 wherein the adjusting means further includes a pair of torsion springs in biased contact with the ski.

6. Apparatus for cleaning a recording medium in the form of an endless belt extended between at least a pair of rollers, having a recording surface on which a developed image comprised of particles is formed and a back surface opposite said recording surface, the cleaning apparatus comprising:

magnetic brush means for removing residual particles on the recording surface, said means for removing being disposed on the recording surface side of said recording medium;

supporting means for supporting the back surface of the recording medium and for biasing the recording surface toward said magnetic brush means for removing residual particles, said supporting means including:

a support member mounted downstream of the magnetic brush means and having a supporting surface which faces the back surface of said recording medium, a flexible member on which the support member is mounted, and a biasing means for urging the support member, by itself and with the flexible member, toward the magnetic brush means for removing to urge the supporting surface against the back surface of the recording medium.

* * * * *